US008544112B2

(12) United States Patent
Gosine

(10) Patent No.: US 8,544,112 B2
(45) Date of Patent: Oct. 1, 2013

(54) GUARD AND METHOD OF PROTECTING FOOD FROM GERMS AND CONTAMINATION

(76) Inventor: Nigel Gosine, Calgary (CA)

( * ) Notice: Subject to any disclaimer, the term of this patent is extended or adjusted under 35 U.S.C. 154(b) by 228 days.

(21) Appl. No.: 13/084,815

(22) Filed: Apr. 12, 2011

(65) Prior Publication Data

US 2012/0260389 A1 Oct. 18, 2012

(51) Int. Cl.
*A41D 13/11* (2006.01)

(52) U.S. Cl.
USPC ..... 2/9

(58) Field of Classification Search
USPC ..... 2/9, 424, 174, 202, 203, 206, 11, 2/15, 468, 8.2, 455, 901; 128/863, 859, 857, 128/206.12, 206.21, 206.28, 207.11
See application file for complete search history.

(56) References Cited

U.S. PATENT DOCUMENTS

| | | | | | |
|---|---|---|---|---|---|
| 1,191,773 | A | * | 7/1916 | Dinkuhn | 2/11 |
| 2,564,952 | A | * | 8/1951 | Blasius | 2/11 |
| 4,286,170 | A | * | 8/1981 | Moti | 250/515.1 |
| D287,300 | S | * | 12/1986 | Lonnstedt | D29/110 |
| 4,825,878 | A | * | 5/1989 | Kuntz et al. | 128/857 |
| 4,853,974 | A | * | 8/1989 | Olim | 2/9 |
| 4,867,178 | A | * | 9/1989 | Smith | 128/858 |
| 4,884,296 | A | * | 12/1989 | Nix, Jr. | 2/11 |
| 4,986,282 | A | | 1/1991 | Stackhouse et al. | |
| 5,406,944 | A | * | 4/1995 | Gazzara | 128/206.19 |
| 5,440,760 | A | * | 8/1995 | Highsmith | 2/9 |
| 5,500,954 | A | * | 3/1996 | Smith et al. | 2/9 |
| D377,850 | S | * | 2/1997 | Smith et al. | D29/108 |
| 5,642,528 | A | * | 7/1997 | Dering | 2/174 |
| 5,732,410 | A | | 3/1998 | Machson | |
| 5,765,223 | A | * | 6/1998 | McCausland | 2/9 |
| 6,374,829 | B1 | * | 4/2002 | Chapman | 128/857 |
| D588,333 | S | | 3/2009 | Struebing | |
| 2002/0053348 | A1 | | 5/2002 | Chapman | |
| 2002/0134390 | A1 | | 9/2002 | Salatka et al. | |
| 2005/0120452 | A1 | | 6/2005 | Cominsky | |
| 2007/0113322 | A1 | | 5/2007 | Tredup | |
| 2008/0216214 | A1 | | 9/2008 | Dolby | |
| 2010/0031410 | A1 | | 2/2010 | Clark | |
| 2010/0326444 | A1 | * | 12/2010 | Shim | 128/206.13 |
| 2011/0197898 | A1 | * | 8/2011 | Chiu | 128/859 |

* cited by examiner

*Primary Examiner* — Amy Vanatta
(74) *Attorney, Agent, or Firm* — Maxey Law Offices, PLLC; Stephen Lewellyn

(57) ABSTRACT

A guard includes a transparent face shield, a neck strap having one end secured to one side of the guard and a second end secured to the opposite side of the guard, and a neck opening defined by the guard and the neck strap. The guard is worn by user with the user's neck extending through said neck opening such that said guard depends from the user's neck by said neck strap with an edge of said guard in contact with the user's chest and with said face shield extending upwardly in a direction from the user's chest shielding the user's face. The guard, when worn by the user, protects foodstuff handled by the user from contamination by the user sneezing or from other material falling from the user's head and/or face.

7 Claims, 2 Drawing Sheets

GUARD AND METHOD OF PROTECTING FOOD FROM GERMS AND CONTAMINATION

FIELD OF THE INVENTION

The present invention relates generally to shields for protecting food from germs and contamination by people preparing and/or handling the food, and more particularly, relating to a wearable guard and method of protecting food from germs and contamination using the wearable guard.

BACKGROUND OF THE INVENTION

Sneeze guards have be utilized for a number of years to protect food arrange on a buffet from contamination by people handling the food during plating. Conventionally, sneeze guards include large glass planes or planes of other transparent material, such as plexi-glass, fixedly secured in place as a barrier between people and food laid out along a buffet. While sneeze guards, when used properly, perform a decent job of protecting the foodstuff from contamination by the public consumer, it is not practical to utilize conventional sneeze guards to prevent contamination during the preparation and/or handling of the food by cook staff and wait staff.

Accordingly, there is a desire for a practical solution to protect food from germs and contamination during handling and preparation by cook staff and/or wait staff.

SUMMARY OF THE INVENTION

The embodiments of the present invention address this need by providing a wearable guard of a particular construction and a method protecting food from germs and contaminations utilizing the wearable guard.

To achieve these and other advantages, in general, in one aspect, method of protecting food from germs and contaminations is provided. The method includes providing a guard including a transparent face shield, a neck strap having one end secured to one side of the guard and a second end secured to the opposite side of the guard, and a neck opening defined by the guard and the neck strap. And, positioning the guard on a user with the user's neck extending through the neck opening such that the guard depends from the user's neck by the neck strap with an edge of the guard in contact with the user's chest and with the face shield extending upwardly in a direction from the user's chest shielding the user's face.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
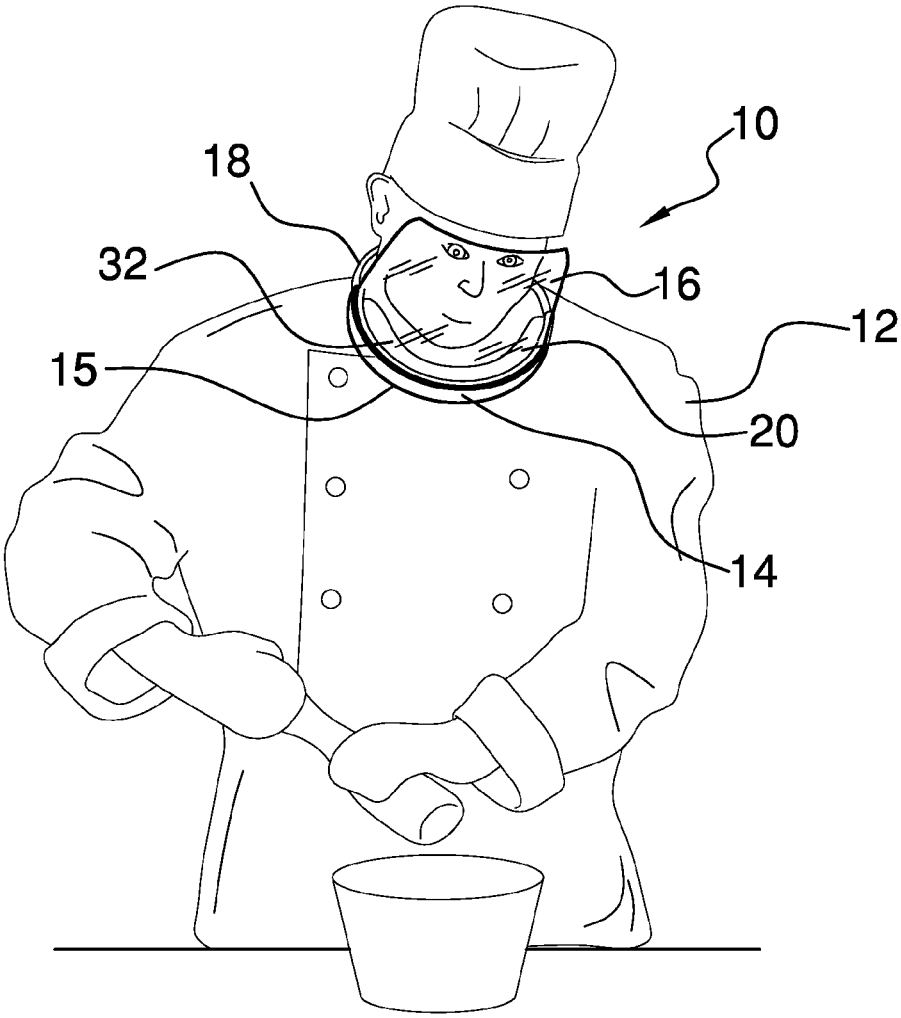
FIG. 1 is a perspective environmental view of a guard and method of protecting food from germs and contaminations in accordance with the principles of the present invention.
Figure 2:
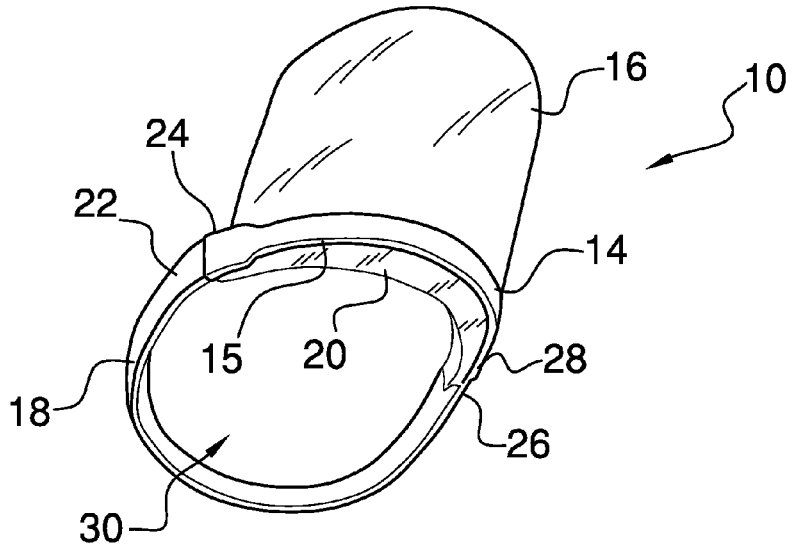
FIG. 2 is a diagrammatic perspective view of the guard of FIG. 1.
Figure 3:
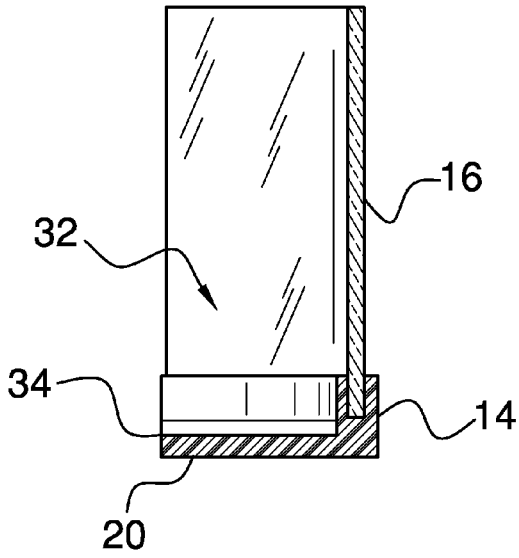
FIG. 3 is a partial cross-sectional view of the guard including a liner.

With reference to FIGS. 1 through 3 a method of protecting food from germs and contaminations will be described. The method includes providing a guard 10 to be worn by a person 12 for shielding a person's face during the handling and/or preparation of foodstuff to prevent contamination and germs.

The guard 10 includes a semi-circular rim 14, a transparent face shield 16, a neck strap 18 and may be further provided with a chest plate 20. The semi-circular rim 14 has a chest engaging edge 15 which contacts the user's chest when the guard is worn by the user. The transparent face shield 16 is secured to the semi-circular rim 14 and extends in a generally upwardly direction therefrom to shield the face of the user when worn by user. A first end 22 of the neck strap 18 is attached to side 24 of the guard and a second end 26 of the neck strap 18 is attached to an opposite side 28 of the guard. The rim 14 and neck strap 18 define a neck opening 30 through which the user's neck extends when the guard it worn. The chest plate 20 extends from an interior side of the rim and runs along the rim 14 between sides 24 and 28 thereof. The chest plate 20 conjointly with the rim 14 provides a reception area 32 for the collection of any matter that may fall from the user's face and/or head and preventing the matter from contacting the foodstuff being prepared or handled by the user.

With particular reference to FIG. 1, the guard 10 is positioned on the user 12 with the neck of the user extending through the neck opening 30 and with the guard generally depending from the user's neck by the neck strap 18. Other than the neck strap 18, no other structure of the guard 10 is attached to the user. The guard 10 is positioned such that chest engaging edge 15 contacts and lies substantially against the user's chest without a gap between the chest engaging edge and the user's chest. Guard 10 is further positioned such that the face shield 16 extends in a direction generally upwardly from the user's chest shielding the user's face.

In the instance where the chest plate 20 is provided, the guard is further positioned such that the chest plate contacts and lies substantially against the user's chest without a gap between the chest plate and the user's chest. In this manner, any material that may fall from the user's face and/or head is collected within the reception area 32. With, reference to FIG. 3, a replaceable liner 34 may be removably attached to chest plate 20. Liner 34 may include anti-microbial coating or may be impregnated with an anti-microbial solution. Liner 34 may include a pressure sensitive backing permit the removable attachment to chest plate 20.

In embodiments, either or both ends 22 and 24 of the neck strap 18 may be removably attached to the guard 10. In this manner one end may be temporary disconnected and then reconnected when putting on or removing the guard. In other embodiment, the face shield 16 may include an anti-fog coating to prevent fogging thereof while being worn.

A number of embodiments of the present invention have been described. Nevertheless, it will be understood that various modifications may be made without departing from the spirit and scope of the invention. Accordingly, other embodiments are within the scope of the following claims.

What is claimed is:

1. A method of protecting food from germs and contaminations, the method comprising the steps of:

providing a guard including a transparent face shield, a neck strap having one end secured to one side of said guard and a second end secured to the opposite side of said guard, and a neck opening defined by said guard and said neck strap, and a chest plate; and positioning said guard on a user with the user's neck extending through said neck opening such that said guard depends from the user's neck by said neck strap with said chest plate laying against the user's chest and with said face shield extending upwardly in a direction from the user's chest shielding the user's face.

2. The method of claim 1, wherein said face shield is curved in transverse cross-section.

3. The method of claim 1, wherein said neck strap is attached to said guard approximate said edge thereof which is in contact with the user's chest.

4. The method of claim 1, wherein said guard further includes a liner attached to said chest plate.

5. The method of claim 4, wherein said liner include an anti-microbial coating.

6. The method of claim 4, wherein said liner is impregnated with an anti-microbial solution.

7. The method of claim 1, wherein said chest plate extends from an interior side of a rim of said transparent face shield and along said rim between opposed sides thereof, said chest plate and said rim conjointly providing a reception area.

* * * * *